US005776394A

United States Patent [19]

Schrott et al.

[11] Patent Number: 5,776,394

[45] Date of Patent: Jul. 7, 1998

[54] PROCESS FOR MANUFACTURING CELLULOSE FIBRES

[75] Inventors: Wolfgang Schrott, Böhl-Iggelheim; Wolfram Badura, Mannheim, both of Germany

[73] Assignee: BASF Aktiengesellschaft, Ludwigshafen, Germany

[21] Appl. No.: 793,607

[22] PCT Filed: Aug. 22, 1995

[86] PCT No.: PCT/EP95/03327

§ 371 Date: Mar. 6, 1997

§ 102(e) Date: Mar. 6, 1997

[87] PCT Pub. No.: WO96/07780

PCT Pub. Date: Mar. 14, 1996

[30] Foreign Application Priority Data

Sep. 6, 1994 [DE] Germany ..... 44 31 635.6

[51] Int. Cl.[6] ..... D01F 11/02; D06M 15/564

[52] U.S. Cl. ..... 264/129; 264/203; 264/211.14

[58] Field of Search ..... 264/129, 187, 264/203, 211.14

[56] References Cited

FOREIGN PATENT DOCUMENTS

| | | |
|---|---|---|
| 359 039 | 3/1990 | European Pat. Off. . |
| 392 349 | 10/1990 | European Pat. Off. . |
| 538977 | 4/1993 | European Pat. Off. . |
| 621 366 | 10/1994 | European Pat. Off. . |
| 6-146168 | 5/1994 | Japan . |
| 2043525 | 10/1980 | United Kingdom . |
| 92/07124 | 4/1992 | WIPO . |
| 94/20656 | 9/1994 | WIPO . |
| 95/00697 | 1/1995 | WIPO . |

OTHER PUBLICATIONS

Abstract of Japan 6–146,168 (Published May 27, 1994).

*Primary Examiner*—Leo B. Tentoni
*Attorney, Agent, or Firm*—Oblon, Spivak, McClelland, Maier & Neustadt, P.C.

[57] ABSTRACT

Solvent-spun cellulose fibers having a reduced tendency to fibrillate are produced by treating the fibers with one or more compounds from the group of the (A) N-methylol ethers of carboxamides, urethanes, ureas and aminotriazines, (B) N-alkyl-mono- or polysubstituted cyclic hydroxy- or alkoxy-ethyleneureas, (C) hydrophilic modified polyisocyanates, and (D) mixtures of polyurethanes with isocyanates.

10 Claims, No Drawings

PROCESS FOR MANUFACTURING CELLULOSE FIBRES

BACKGROUND OF THE INVENTION

1. Field of the Invention

The present invention relates to a novel process for producing solvent-spun cellulose fibers having a reduced tendency to fibrillate by treating the fibers with certain reactive compounds.

2. Discussion of the Background

GB-A-2 043 525 discloses the production of cellulose fibers by spinning a solution of cellulose in a suitable solvent, for example an N-oxide of a tertiary amine, such as N-methylmorpholine N-oxide. In such a spinning process, the cellulose solution is extruded through a suitable die and the resulting fiber precursor is washed in water and thereafter dried. Such fibers are referred to as solvent-spun fibers.

Such solvent-spun cellulose fibers have many application advantages, but tend to fibrillate, i.e. to break up into very fine fibrils, which can lead to problems with the textile processing of cellulose fibers.

WO-A-92/07124 recommends solving this problem by treating the cellulose fibers with an aqueous solution or dispersion of a polymer having a multiplicity of cationically ionizable groups, for example a polyvinylimidazoline.

Furthermore, EP-A-538 977 teaches the use of compounds having from 2 to 6 functional groups capable of reacting with cellulose, for example products based on dichlorotriazine, for this purpose.

SUMMARY OF THE INVENTION

It is an object of the present invention to provide a novel process for producing solvent-spun cellulose fibers having a reduced tendency to fibrillate on the basis of different chemical defibrillating reagents.

We have found that this object of producing solvent-spun cellulose fibers having a reduced tendency to fibrillate is advantageously achieved by a process which comprises treating the fibers with one or more compounds from the group of the (A) N-methylol ethers of carboxamides, urethanes, ureas and aminotriazines, (B) N-alkyl-mono- or polysubstituted cyclic hydroxy- or alkoxy-ethyleneureas, (C) hydrophilic modified polyisocyanates, and (D) mixtures of polyurethanes with isocyanates.

In a preferred embodiment, compounds (A) comprise N-methylol ethers of the general formula I

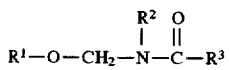

(I)

where $R^1$ is $C_1$–$C_{10}$-alkyl with or without interruption by unadjacent oxygen atoms, $R^2$ is hydrogen, $CH_2OR^1$ or a $C_1$–$C_8$-alkyl radical with or without hydroxyl and/or $C_1$–$C_4$-alkoxy substitution and with or without interruption by unadjacent oxygen atoms and/or $C_1$–$C_4$-alkyl-bearing nitrogen atoms, and $R^3$ is hydrogen, $C_1$–$C_{10}$-alkyl, $C_1$–$C_{10}$-alkoxy with or without interruption by unadjacent oxygen atoms, or the group (—$NR^2$—$CH_2OR^1$), or else $R^2$ and $R^3$ form a five- or six-membered ring and if $R^3$=(—$NR^2$—$CH_2OR^1$), moreover, two such rings may be fused together via the carbon atoms on the $R^2$ radicals a-disposed to the amide nitrogens to form a bicyclic system.

DETAILED DESCRIPTION OF THE PREFERRED EMBODIMENTS

The N-methylol ethers I are readily obtainable by conventional reaction, usually in aqueous solution, of the corresponding N-methylol compounds of the general formula II

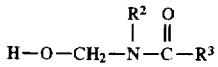

(II)

with alcohols of the general formula III $$R^1—OH. \quad (III)$$

The radical $R^1$ *is a* $C_1$–$C_{10}$-alkyl group with or without interruption by unadjacent oxygen atoms, such as —$CH_2CH_2OCH_3$, —$CH_2CH_2OCH_2CH_3$ or —$CH_2CH_2OCH_2CH_2OCH_3$. Further examples of $R^1$ are n-butyl, isobutyl, sec-butyl, tert-butyl, n-pentyl, n-hexyl, 2-ethylhexyl and 2-methoxyethyl; of particular interest are the $C_1$–$C_3$-alkyl groups ethyl, n-propyl, isopropyl and especially methyl.

The radical $R^2$ is hydrogen, $CH_2OR^1$ or, in particular, a $C_1$–$C_8$-alkyl radical with or without hydroxyl and/or $C_1$–$C_4$-alkoxy substitution and with or without interruption by unadjacent oxygen atoms and/or $C_1$–$C_4$-alkyl-bearing nitrogen atoms.

The radical $R^3$ is hydrogen, $C_1$–$C_{10}$-alkyl, $C_1$–$C_{10}$-alkoxy with or without interruption by unadjacent oxygen atoms or, in particular, the group (—$NR^2$—$CH_2OR^1$).

The process of this invention is particularly effective with those N-methylol ethers I where $R^2$ and $R^3$ form a five- or six-membered ring. If $R^3$=(—$NR^2$—$CH_2OR^1$), moreover, two such rings may be fused together via the carbon atoms on the $R^2$ radicals α-disposed to the amide nitrogens to form a bicyclic system.

Examples of N-methylol ethers I which can be used in the process of this invention are:

amides of $C_1$–$C_{11}$-carboxylic acids, for example formic acid, acetic acid, propionic acid, butyric acid or valeric acid, which carry one or two $CH_2OR^1$ groups on the nitrogen, carbamates having $C_1$–$C_{10}$-alkyl groups in the ester moiety which may be interrupted by unadjacent oxygen atoms, for example methyl, ethyl, n-propyl, isopropyl, 2-methoxyethyl or n-butyl, which carry two $CH_2OR^1$ groups on the nitrogen, urea having from 1 to 4 $CH_2$—$OR^1$ groups on the nitrogen atoms, cyclic ethyleneureas of the general formula Ia

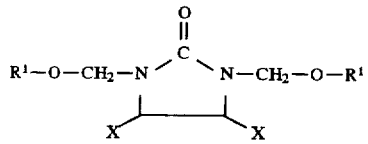

(Ia)

where the radicals X are different or preferably identical and each is hydrogen, hydroxyl or $C_1$-$C_4$-alkoxy, for example methoxy or ethoxy, cyclic propyleneureas of the general formula Ib

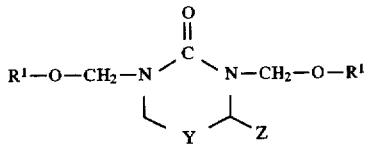

(Ib)

where Y is $CH_2$, CHOH, $C(CH_3)_2$, an oxygen atom or a $C_1$-$C_4$-alkyl-bearing nitrogen atom, and Z is hydrogen or a $C_1$-$C_4$-alkoxy group, for example methoxy or ethoxy, bicyclic glyoxal diureas of the general formula IC

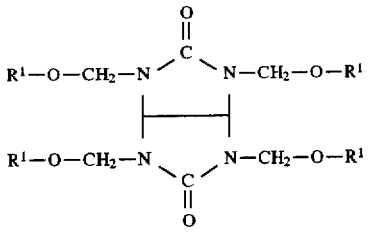

(Ic)

bicyclic malonodialdehydediureas of the general formula Id

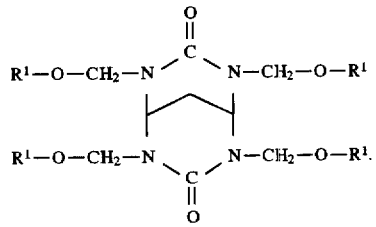

(Id)

In a further preferred embodiment, compounds (A) comprise melamine derivatives of the general formula IV

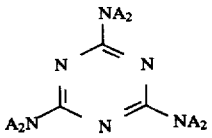

(IV)

where the radicals A are identical or different and each is hydrogen or $CH_2OR^1$, subject to the proviso that at least one of the radicals A is $CH_2OR^1$ and $R^1$ is as defined above.

The melamine derivatives IV are readily obtainable by conventional reaction, usually in aqueous solution, of the corresponding N-methylolmelamines of the general formula V

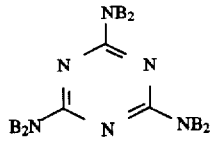

(V)

where the A analogs B are each hydrogen or $CH_2OH$, with alcohols of the general formula III.

Examples of melamine derivatives which can be used in the process of this invention are methoxymethylmelamine, bis(methoxymethyl)melamine, tris(methoxymethyl) melamine, tetrakis(methoxymethyl)melamine, pentakis (methoxymethyl)melamine and hexakis(methoxymethyl) melamine and also the analogous ethoxymethyl and isopropyloxymethyl compounds.

Compounds (A) are known in the textile field as crosslinkers in the low-aldehyde resin finishing of cellulosic textile materials.

In a further preferred embodiment, compounds (B) comprise cyclic hydroxy- or alkoxy-ethyleneureas of the general formula VI

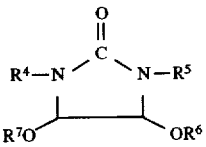

(VI)

where $R^4$ and $R^5$ are each hydrogen or $C_1$–$C_3$-alkyl, with the proviso that at least one of the radicals $R^4$- and $R^5$ is $C_1$-$C_3$-alkyl, and $R^6$ and $R^7$ are each hydrogen or $C_1$–$C_4$-alkyl.

Compounds (B) are known in the textile field as crosslinkers in the aldehyde-free resin finishing of cellulosic textile materials.

The hydrophilic modified polyisocyanates (C) are generally used in the processes of the invention in the form of aqueous dispersions which are essentially free from organic solvents and further emulsifiers The hydrophilic modified polyisocyanates to be used according to this invention are based on customary diisocyanates and/or customary higher functional polyisocyanates having an average NCO functionality of from 2.0 to 4.5. These components can be present alone or mixed.

Examples of customary diisocyanates are aliphatic diisocyanates such as tetramethylene diisocyanate, hexamethylene diisocyanate (1,6-diisocyanatohexane), octamethylene diisocyanate, decamethylene diisocyanate, dodecamethylene diisocyanate, tetradecamethylene diisocyanate, trimethylhexane diisocyanate or tetramethylhexane diisocyanate, cycloaliphatic diisocyanates such as 1,4-, 1,3- or 1,2-diisocyanatocyclohexane, 4,4'-di(isocyanato-cyclohexyl) methane, 1-isocyanato-3,3,5-trimethyl-5-(isocyanatomethyl) cyclohexane (isophorone diisocyanate) or 2,4- or 2,6-diisocyanato-1-methylcyclohexane and also aromatic diisocyanates such as 2,4- or 2,6-tolylene diisocyanate, tetramethylxylylene diisocyanate, p-xylylene diisocyanate, 2,4'- or 4,4'-diisocyanatodiphenylmethane, 1,3- or 1,4-phenylene diisocyanate, 1-chloro-2,4-phenylene diisocyanate, 1,5-naphthylene diisocyanate, diphenylene 4,4'-diisocyanate, 4,4'-diisocyanato-3,3'-dimethyldiphenyl, 3-methyldiphenylmethane 4,4'-diisocyanate or diphenyl ether 4,4'-diisocyanate. It is also possible for mixtures of the diisocyanates mentioned to be present. Preference is given among these to aliphatic diisocyanates, in particular to hexamethylene diisocyanate and isophorone diisocyanate.

Suitable customary higher functional polyisocyanates are for example triisocyanates such as 2,4,6-triisocyanatotoluene or 2,4,4'-triisocyanatodiphenyl ether or the mixtures of di-, tri- and higher polyisocyanates which are obtained by phosgenation of corresponding aniline/formaldehyde condensates and are methylene-bridged polyphenyl polyisocyanates.

Of particular interest are customary aliphatic higher functional polyisocyanates of the following groups:

(a) isocyanurato-containing polyisocyanates of aliphatic and/or cycloaliphatic diisocyanates. Particular preference amongst these is given to the corresponding isocyanato-isocyanurates based on hexamethylene diisocyanate and isophorone diisocyanate. The present isocyanurates are in particular simple trisisocyanatoalkyl or triisocyanatocycloalkyl isocyanurates which are cyclic trimers of the diisocyanates, or mixtures with their higher homologs having more than one isocyanurate ring. The isocyanatoisocyanurates generally have an NCO content of from 10 to 30% by weight, in particular of from 15 to 25% by weight, and an average NCO functionality of from 2.6 to 4.5.

(b) Uretdione diisocyanates having aliphatically and/or cycloaliphatically bound isocyanate groups, preferably derived from hexamethylene diisocyanate or isophorone diisocyanate. Uretdione diisocyanates are cyclic dimerization products of diisocyanates.

(c) Biureto-containing polyisocyanates having aliphatically bound isocyanate groups, in particular tris(6-isocyanatohexyl) biuret or its mixtures with its higher homologs. These biureto-containing polyisocyanates generally have an NCO content of from 18 to 25% by weight and an average NCO functionality of from 3 to 4.5.

(d) Urethano- and/or allophanato-containing polyisocyanates with aliphatically or cycloaliphatically bound isocyanate groups, as obtainable for example by reacting excess amounts of hexamethylene diisocyanate or isophorone diisocyanate with simple polyhydric alcohols such as trimethylolpropane, glycerol, 1,2-dihydroxypropane or mixtures thereof. These urethano- and/or allophanato-containing polyisocyanates generally have an NCO content of from 12 to 20% by weight and an average NCO functionality of from 2.5 to 3.

(e) Oxadiazinetriono-containing polyisocyanates, preferably derived from hexamethylene diisocyanate or isophorone diisocyanate. Such oxadiazinetriono-containing polyisocyanates are preparable from diisocyanate and carbon dioxide.

(f) uretoneimine-modified polyisocyanates.

For the use according to the present invention, particular preference is given to aliphatic diisocyanates and aliphatic higher functional polyisocyanates.

The disclosed diisocyanates and/or higher functionalized polyisocyanates are converted into nonionically hydrophilic modified polyisocyanates, which are particularly preferred for the use according to the present invention, by reaction with NCO-reactive compounds containing hydrophilicizing structural elements with nonionic groups or with polar groups which cannot be converted into ionic groups. In this reaction, the diisocyanate or polyisocyanate, as the case may be, is present in stoichiometric excess in order that the resulting hydrophilic modified polyisocyanate may still contain free NCO groups.

Suitable for use as such NCO-reactive compounds with hydrophilicizing structural elements are in particular hydroxyl-terminated polyethers of the general formula VII $$R^8—E—(DO)_n—H \quad (VII)$$

where $R^8$ is $C_1$–$C_{20}$-alkyl, in particular $C_{1-C4}$-alkyl, or $C_2$–$C_{20}$-alkenyl, cyclopentyl, cyclohexyl, glycidyl, hydroxyethyl, phenyl, tolyl, benzyl, furfuryl or tetrahydrofurfuryl, E is sulfur or in particular oxygen, D is propylene or especially ethylene, including in particular block-mixed ethoxylated and propoxylated compounds, and n is from 5 to 120, in particular 10 to 25.

The use of nonionically hydrophilic modified polyisocyanates which contain the polyethers VII therefore also constitutes a preferred embodiment.

These are particularly preferably $C_1$–$C_4$-alkanol-initiated ethylene oxide or propylene oxide polyethers having average molecular weights from 250 to 7000, in particular from 450 to 1500.

It is also possible to first react the disclosed diisocyanates and/or higher functionalized polyisocyanates with a deficiency of hydroxyl-terminated polyesters, of other hydroxyl-terminated polyethers, or of polyols, for example ethylene glycol, trimethylolpropane or butanediol, to form prepolymers and then react these prepolymers subsequently or else simultaneously with the polyethers VII in deficiency to form the hydrophilic modified polyisocyanates having free NCO groups.

It is also possible to prepare nonionically hydrophilic modified polyisocyanates from diisocyanate or polyisocyanate and polyalkylene glycols of the formula $HO—(DO)_n—H$, where D and n are each as defined above. In this reaction, the two terminal OH groups of the polyalkylene glycol both react with isocyanate.

The recited types of nonionically hydrophilic modified polyisocyanates are more particularly described in DE-A 24 47 135, DE-A 26 10 552, DE-A 29 08 844, EP-A 0 13 112, EP-A 019 844, DE-A 40 36 927, DE-A 41 36 618, EP-B 206 059, EP-A 464 781 and EP-A 516 361.

The disclosed diisocyanates and/or higher functionalized polyisocyanates are converted into anionically hydrophilic modified polyisocyanates by reaction with NCO-reactive compounds containing hydrophilicizing anionic groups, in particular acid groups such as carboxyl groups, sulfonic acid groups or phosphonic acid groups. In this reaction, the diisocyanate or polyisocyanate is present in stoichiometric excess in order that the resulting hydrophilic modified polyisocyanate may still contain free NCO groups.

Suitable NCO-reactive compounds with anionic groups include in particular hydroxycarboxylic acids such as 2-hydroxyacetic acid, 3-hydroxypropionic acid, 4-hydroxybutyric acid or hydroxypivalic acid and 2,2,2-tris- and also 2,2-bis-(hydroxymethyl)alkanoic acids, for example 2,2-bis(hydroxymethyl)acetic acid, 2,2-bis-(hydroxymethyl)propionic acid, 2,2-bis(hydroxymethyl) butyric acid, or 2,2,2-tris(hydroxymethyl)acetic acid. The carboxyl groups can be partly or wholly base-neutralized to be present in a water-soluble or water-dispersible form. The base used here is preferably a tertiary amine, which is known to be inert toward isocyanate.

The disclosed diisocyanates and/or higher functionalized polyisocyanates can also be reacted with a mixture of nonionically hydrophilic-modifying and anionically hydrophilic-modifying compounds which are added in succession or simultaneously, for example with a deficiency of the polyethers VII and the disclosed hydroxycarboxylic acids.

The recited types of anionically hydrophilic modified polyisocyanates are more particularly described in DE-A 40 01 783, DE-A 41 13 160 and DE-A 41 42 275.

The disclosed diisocyanates and/or higher functionalized polyisocyanates are converted into cationically hydrophilic modified polyisocyanates by reaction with NCO-reactive compounds containing chemically built-in alkylatable or protonatable functions to form a cationic center. These functions are in particular tertiary nitrogen atoms, which are known to be inert toward isocyanate and to be readily quaternizable or protonatable. In the reaction of diisocyanate or polyisocyanate with these NCO-reactive compounds, the former are present in excess in order that the resulting hydrophilic modified polyisocyanate may still contain free NCO groups.

Suitable such NCO-reactive compounds with tertiary nitrogen atoms are preferably aminoalcohols of the general formula VIII

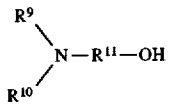

(VIII)

where $R^9$ and $R^{10}$ are each linear or branched $C_1$–$C_{20}$-alkyl, in particular $C_1$–$C_5$-alkyl, or are together combined with the nitrogen atom into a five- or six-membered ring which may additionally contain an oxygen atom or a tertiary nitrogen atom, in particular a piperidine, morpholine, piperazine, pyrrolidine, oxazoline or dihydrooxazine ring, in which case the radicals $R^2$ and $R^3$ may additionally carry hydroxyl groups, in particular one hydroxyl group each, and $R^{11}$ is $C_2$–$C_{10}$-alkylene, in particular $C_2$–$C_6$-alkylene, which can be linear or branched.

Suitable aminoalcohols VIII are in particular N-methyldiethanolamine, N-methyldi(iso)propanolamine, N-butyldiethanolamine, N-butyldi(iso)propanolamine, N-stearyldiethanolamine, N-stearyldi(iso)propanolamine, N,N-dimethylethanolamine, N,N-dimethyl(iso)propanolamine, N,N-diethylethanolamine, N,N-diethyl(iso)propanolamine, N,N-dibutylethanolamine, N,N-dibutyl(iso)propanolamine, triethanolamine, tri(iso)propanolamine, N-(2-hydroxyethyl)morpholine, N-(2-hydroxypropyl)morpholine, N-(2-hydroxyethyl)piperidine, N-(2-hydroxypropyl)piperidine, N-methyl-N'-(2-hydroxyethyl)piperazine, N-methyl-N'-(2-hydroxypropyl)piperazine, N-methyl-N'-(4-hydroxybutyl)piperazine, 2-hydroxyethyloxazoline, 2-hydroxypropyloxazoline, 3-hydroxypropyloxazoline, 2-hydroxyethyldihydrooxazine, 2-hydroxypropyldihydrooxazine or 3-hydroxypropyldihydrooxazine.

Suitable such NCO-reactive compounds with tertiary nitrogen atoms further include preferably diamines of the general formula IXa or IXb

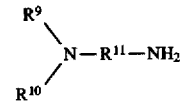

(IXa)

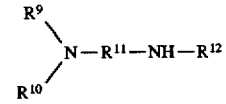

(IXb)

where $R^9$ to $R^{11}$ are each as defined above and $R^{12}$ is $C_1$–$C_5$-alkyl or is combined with $R^2$ into a five- or six-membered ring, in particular into a piperazine ring.

Suitable diamines IXa are in particular N,N-dimethylethylenediamine, N,N-diethylethylenediamine, N,N-dimethyl-1,3-diamino-2,2-dimethylpropane, N,N-diethyl-1,3-propylenediamine, N-(3-aminopropyl)morpholine, N-(2-aminopropyl)morpholine, N-(3-aminopropyl)piperidine, N-(2-aminopropyl)piperidine, 4-amino-1-(N,N-diethylamino)pentane, 2-amino-1-(N,N-dimethylamino)propane, 2-amino-1-(N,N-diethylamino)propane or 2-amino-1-(N,N-diethylamino)-2-methylpropane.

Suitable diamines IXb include in particular N,N,N'-trimethylethylenediamine, N,N,N'-triethylethylenediamine, N-methylpiperazine or N-ethylpiperazine.

Further usable NCO-reactive compounds include polyether(poly)ols with built-in tertiary nitrogen atoms which are preparable by propoxylation and/or ethoxylation of initiator molecules containing amine nitrogen. Such polyether(poly)ols are for example the propoxylation and ethoxylation products of ammonia, ethanolamine, diethanolamine, ethylenediamine or N-methylaniline.

Other usable NCO-reactive compounds are polyester and polyamide resins with tertiary nitrogen atoms, urethano-containing polyols with tertiary nitrogen atoms, and also polyhydroxypolyacrylates with tertiary nitrogen atoms.

The disclosed diisocyanates and/or higher functionalized polyisocyanates can also be reacted with a mixture of nonionically hydrophilic-modifying and cationically hydrophilic-modifying compounds, which are added in succession or simultaneously, for example with a deficiency of the polyethers VII and the aminoalcohols VIII or the diamines IXa or IXb. It is also possible to use mixtures of nonionically hydrophilic-modifying and anionically hydrophilic-modifying compounds.

The recited types of cationically hydrophilic modified polyisocyanates are more particularly described in DE-A 42 03 510 and EP-A 531 820.

Since the hydrophilic modified polyisocyanates (C) mentioned can in general be used in aqueous media, adequate dispersibility of the polyisocyanates must be ensured. Preferably, within the group of the disclosed hydrophilic modified polyisocyanates, certain reaction products of di- or polyisocyanates and hydroxyl-terminated polyethers (polyetheralcohols) such as the compounds VII act as emulsifiers for this purpose.

The good results which are obtained with the hydrophilic modified polyisocyanates (C) in aqueous media are all the more surprising since it had to be expected that isocyanates would rapidly decompose in aqueous medium. Yet, the polyisocyanates used according to this invention have a "pot life" of several hours in the aqueous liquor; that is, the instant polyisocyanate dispersions are stable during the customary processing time. A dispersion is said to be stable when its components remain dispersed in one another without their separating into discrete layers. By "pot life" is meant the time during which the dispersions remain processible before they gel and set. Aqueous isocyanate dispersions gel and set because a reaction takes place between the water and the isocyanate to form a polyurea.

The mixtures of polyurethanes and isocyanates (D) are, like the compounds (C), generally used in the process of this invention in the form of aqueous dispersions which are essentially free from organic solvents and in most cases free from emulsifiers.

Polyurethanes are systems constructed from polyisocyanates (hereinafter also known as monomers I) and polyisocyanate-reactive compounds having at least one hydroxyl group and optionally compounds having at least one primary or secondary amino group. Polyurethanes generally do not contain free isocyanate groups.

Suitable polyisocyanates for preparing the polyurethanes present in mixtures (D) are customary diisocyanates and/or customary higher functional polyisocyanates of the type described in connection with the hydrophilic modified polyisocyanates (C). Here too aliphatic diisocyanates and aliphatic higher functional polyisocyanates are preferred.

The further formative components of the polyurethane are initially polyols having a molecular weight of from 400 to 6000 g/mol, preferably from 600 to 4000 g/mol (monomers II).

Polyetherpolyols or polyesterpolyols in particular are suitable. The polyesterdiols are in particular the known reaction products of dihydric alcohols with dibasic carboxylic acids. Instead of the free polycarboxylic acids, it is also possible to use the corresponding polycarboxylic anhydrides or corresponding polycarboxylic esters of lower alcohols or of their mixtures for preparing the polyesterpolyols. The polycarboxylic acids can be aliphatic, cycloaliphatic, aromatic or heterocyclic with or without substitution, for example by halogen atoms, and/or unsaturation. Examples are succinic acid, adipic acid, suberic acid, azeleic acid, sebacic acid, phthalic acid, isophthalic acid, phthalic anhydride, tetrahydrophthalic anhydride, hexahydrophthalic anhydride, tetrachlorophthalic anhydride, endomethylenetetrahydrophthalic anhydride, glutaric anhydride, maleic acid, maleic anhydride, fumaric acid, dimeric fatty acids. Examples of suitable polyhydric alcohols are ethylene glycol, 1,2-propylene glycol, 1,3-propylene glycol, 1,4-butanediol, 1,3-butanediol, 1,4-butenediol, 1,4-butynediol, 1,5-pentanediol, 1,6-hexanediol, 1,8-octanediol, neopentylglycol, cyclohexanedimethanol (1,4-bishydroxymethylcyclohexane), 2-methyl-1,3-propanediol, 1,5-pentanediol, also diethylene glycol, triethylene glycol, tetraethylene glycol, polyethylene glycol, dipropylene glycol, polypropylene glycol, dibutylene glycol and polybutylene glycols.

It is also possible to use lactone-based polyester diols comprising homo- or copolymers of lactones, preferably terminally hydroxyl-substituted addition products of lactones or lactone mixtures, for example ε-caprolactone, β-propiolactone, γ-butyrolactone and/or methyl-ε-caprolactone, on suitable difunctional initiator molecules, for example the low molecular weight dihydric alcohols mentioned above as formative components for the polyesterpolyols. The corresponding polymers of ε-caprolactone are particularly preferred. Similarly, lower polyesterdiols or polyetherdiols can be used as initiators for preparing the lactone polymers. Instead of the polymers of lactones it is also possible to use the corresponding, chemically equivalent polycondensates of the hydroxycarboxylic acids corresponding to the lactones.

The polyetherdiols, which are usable alone or else mixed with polyesterdiols, are obtainable in particular by homopolymerization of ethylene oxide, propylene oxide, butylene oxide, tetrahydrofuran, styrene oxide or epichlorohydrin, for example in the presence of $BF_3$, or by addition of these compounds, mixed or in succession, to initiating components having reactive hydrogen atoms, such as alcohols or amines, for example water, ethylene glycol, 1,3-propylene glycol, 1,2-propylene glycol, 4,4'-dihydroxydiphenylpropane, aniline.

The proportion of the above-described monomer II is generally from 0.1 to 0.8 gram equivalent, preferably from 0.2 to 0.7 gram equivalent, of the hydroxyl group of the monomer II based on 1 gram equivalent of isocyanate of the polyisocyanate.

The further formative components of the polyurethane are chain extenders or crosslinkers having at least two isocyanate-reactive groups selected from hydroxyl groups, primary or secondary amino groups.

Suitable representatives are polyols, especially diols and triols, having a molecular weight within the range from less than 400 g/mol to 62 g/mol (monomers III).

More particularly, the above-recited diols and triols suitable for preparing the polyesterpolyols and also more-than-trifunctional alcohols such as pentaerythritol or sorbitol are suitable.

The proportion of monomers III is generally within the range from 0 to 0.8, in particular from 0 to 0.7, gram equivalent, based on 1 gram equivalent of isocyanate.

The optional monomers IV are at least difunctional amine chain extenders or crosslinkers of the molecular weight range 32 to 500 g/mol, preferably 60 to 300 g/mol, which contain at least two primary, two secondary or one primary and one secondary amino group.

Examples thereof are diamines, such as diaminoethane, diaminopropanes, diaminobutanes, diaminohexanes, piperazine, 2,5-dimethylpiperazine, amino-3-aminomethyl-3,5,5-trimethyl-cyclohexane (isophoronediamine, IPDA), 4,4'-diaminodicyclohexylmethane, 1,4-diaminocyclohexane, aminoethylethanolamine, hydrazine, hydrazine hydrate or triamines such as diethylenetriamine or 1,8-diamino-4-aminomethyloctane. The amino-containing chain extenders can also be used in blocked form, for example in the form of the corresponding ketimines (see for example CA-1 129 128), ketazines (cf. for example U.S. Pat. No. 4,269,748) or amine salts (see U.S. Pat. No. 4,292,226). Similarly, oxazolidines as used for example in U.S. Pat. No. 4,192,937 are blocked polyamines which can be used for chain-extending the prepolymers in the preparation of the polyurethanes of this invention. When such blocked polyamines are used, they are generally mixed with the prepolymers in the absence of water, and this mixture is then mixed with the dispersing water, or some of the dispersing water, so that the corresponding polyamines are formed as intermediates by hydrolysis.

Preference is given to using mixtures of di- and triamines, particularly preferably mixtures of isophoronediamine and diethylenetriamine.

The optional monomers V for use as chain extenders are aminoalcohols having a hydroxyl and a primary or secondary amino group such as ethanolamine, isopropanolamine, methylethanolamine or aminoethoxyethanol.

The proportion of monomers IV or V is in each case preferably from 0 to 0.4, particularly preferably from 0 to 0.2, gram equivalent, based on 1 gram equivalent of isocyanate of the polyisocyanate.

As further formative components, it is possible to use compounds having at least one, preferably two, isocyanate-reactive groups, i.e. hydroxyl, primary or secondary amino groups, and also, unlike the above-described monomers, ionic groups or potentially ionic groups which can be converted into ionic groups by a simple neutralization or quaternization reaction (monomers VI). Incorporation of the monomers VI renders the polyurethanes self-dispersible; that is, the polyurethanes disperse in water without any need for dispersing aids such as protective colloids or emulsifiers.

The cationic or anionic groups can be incorporated by using compounds having isocyanate-reactive hydrogen atoms and (potential) cationic or (potential) anionic groups. These groups of compounds include for example polyethers having tertiary nitrogen atoms and preferably two terminal hydroxyl groups, as obtainable for example by alkoxylation of amines having two hydrogen atoms bonded to the amine nitrogen, for example methylamine, aniline or N,N'-dimethylhydrazine, in a conventional manner. Such polyethers generally have a molecular weight within the range from 500 to 6000 g/mol.

Preferably, however, the ionic groups are introduced by using comparatively low molecular weight compounds having (potential) ionic groups and isocyanate-reactive groups. Examples thereof are recited in U.S. Pat. Nos. 3,479,310 and 4,056,564 and also GB-1 455 554. Similarly, dihydroxyphosphonates, such as the sodium salt of ethyl 2,3-dihydroxypropanephosphonate, or the corresponding sodium salt of the unesterified phosphonic acid, can be used as ionic formative component.

Preferred (potential) ionic monomers VI are N-alkyldialkanolamines, for example N-methyldiethanolamine, N-ethyldiethanolamine, diaminosulfonates, such as the sodium salt of N-(2-aminoethyl)-2-aminoethanesulfonic acid, dihydroxysulfonates, dihydroxycarboxylic acids such as dimethylolpropionic acid, diaminocarboxylic acids or diaminocarboxylates such as lysine or the sodium salt of N-(2-aminoethyl)-2-aminoethanecarboxylic acid and diamines having at least one additional tertiary amine nitrogen atom, e.g. N-methylbis(3-aminopropyl)amine.

Particular preference is given to diamino- and dihydroxycarboxylic acids, especially to the adduct of ethylenediamine with sodium acrylate or dimethylolpropionic acid.

The potential ionic groups which may be initially incorporated into the polyaddition product are at least partly converted into ionic groups in a conventional manner by neutralization of the potential anionic or cationic groups or by quaternization of tertiary amine nitrogen atoms.

Potential anionic groups, for example carboxyl groups, are neutralized using inorganic and/or organic bases such as alkali metal hydroxides, carbonates or bicarbonates, ammonia or primary, secondary or particularly preferably tertiary amines such as triethylamine or dimethylaminopropanol.

Conversion of the potential cationic groups, for example of tertiary amine groups into corresponding cations, for example ammonium groups, is effected using neutralizing agents comprising inorganic or organic acids, for example hydrochloric acid, phosphoric acid, formic acid, acetic acid, fumaric acid, maleic acid, lactic acid, tartaric acid or oxalic acid, or quaternizing agents comprising, for example, methyl chloride, methyl bromide, methyl iodide, dimethyl sulfate, benzyl chloride, chloroacetic esters or bromoacetamide. Further neutralizing or quaternizing agents are described for example in column 6 of U.S. Pat. No. 3,479,310.

This neutralization or quaternization of the potential ionic groups can be effected before, during or preferably after the isocyanate polyaddition reaction.

The amount of monomer VI is chosen with regard to the degree of neutralization or quaternization of any components with potential ionic groups and is suitably such that the polyurethanes contain from 0.05 to 2, preferably from 0.07 to 1.0, particularly preferably from 0.1 to 0.7, meq of ionic group/g of polyurethane.

If desired, monofunctional amine or hydroxy compounds are also used as formative components (monomers VII). They are preferably monohydric polyetheralcohols of the molecular weight range from 10 500 to 10000 g/mol, preferably from 800 to 5000 g/mol. Monohydric polyetheralcohols are obtainable for example by alkoxylation of monohydric initiator molecules, e.g. methanol, ethanol or n-butanol, using an alkoxylating agent comprising ethylene oxide or mixtures of ethylene oxide with other alkylene oxides, especially propylene oxide. However, if alkylene oxide mixtures are used, these preferably comprise at least 40, particularly preferably at least 65, mol % of ethylene oxide.

Through incorporation of monomers VII, the polyurethanes can thus contain, in internal or terminal polyether chains, polyethylene oxide segments which, alongside the ionic groups, influence the hydrophilic character of the polyurethane and ensure or improve its dispersibility in water.

The compounds of the type mentioned are preferred and preferably used in such amounts that from 0 to 10, preferably from 0 to 5, % by weight of polyethylene oxide units are incorporated into the polyurethane through them.

Further examples of compounds usable as monomers I to VII in the preparation of the disclosed polyurethanes are described for example in High Polymers, Vol. XVI, "Polyurethanes, Chemistry and Technology", by Saunders-Frisch, Interscience Publishers, New York, London, Volume I, 1962, pages 32 to 42 and pages 44 to 54, and Volume II, pages 5 to 6 and 198 to 199.

Examples of suitable monomers VIII, which, unlike the foregoing monomers, contain ethylenically unsaturated groups, include esters of acrylic or methacrylic acid with polyols, in which case at least one OH group of the polyol remains unesterified. Of particular suitability are hydroxyalkyl (meth)acrylates of the formula $HO(CH_2)_mOOC(R^{12})C{=}CH_2$ (m=2–8; $R^{12}$=H, $CH_3$) and their positional isomers, mono(meth)acrylic esters of polyetherdiols, as recited for example in connection with monomers II, trimethylolpropane mono- and di(meth)acrylate, pentaerythritol di- and tri(meth)acrylate or reaction products of epoxy compounds with (meth)acrylic acid, as mentioned for example in U.S. Pat. No. 357,221.

Of particular suitability are the adducts of (meth)acrylic acid with bisglycidyl ethers of diols, for example bisphenol A or butanediol.

It is also possible to use adducts of (meth)acrylic acid with epoxidized diolefins, for example 3,4-epoxycyclohexylmethyl 3',4',-epoxycyclohexanecarboxylate.

Incorporation of monomers VIII makes it possible, if desired, to subsequently cure the polyurethane thermally or photochemically, in the presence or absence of an initiator.

In general, the proportion of ethylenically unsaturated groups is below 0.2 mol per 100 g of polyurethane.

Altogether, the proportion of formative components is preferably chosen so that the sum of the isocyanate-reactive hydroxyl groups and primary or secondary amino groups is from 0.9 to 1.2, preferably from 0.95 to 1.1, based on 1 isocyanate group.

The preparation of the disclosed polyurethanes, especially in the form of dispersions, can be effected according to the customary methods as described for example in the above-cited references.

Preferably, the monomers I and II and optionally III, V, VI, VII and VIII, if VI contains no amino groups, are reacted in an inert, water-miscible solvent, such as acetone, tetrahydrofuran, methyl ethyl ketone or N-methylpyrrolidone, to prepare the polyurethane or, if further reaction with amino-functional monomers IV or VI is intended, a polyurethane prepolymer still having terminal isocyanate groups.

The reaction temperature is generally within the range from 20° C. to 160° C., preferably within the range from 50° C. to 100° C.

The reaction of the diisocyanates can be speeded up by using the customary catalysts, such as dibutyltin dilaurate, tin(II) octoate or diazabicyclo(2.2.2)octane.

The resulting polyurethane prepolymer can be further reacted with amino-functional compounds of monomers VI and optionally IV at from 20° C. to 80° C., optionally after (further) dilution with solvents of the abovementioned kind, preferably with solvents having boiling points below 100° C.

The conversion of potential salt groups, for example carboxyl groups, or tertiary amino groups, which were introduced into the polyurethane via the monomers VI, into the corresponding ions is effected by neutralization with bases or acids or by quaternization of the tertiary amino groups before or during the dispersing of the polyurethane in water.

After the dispersing, the organic solvent can be distilled off if its boiling point is below that of water. Any solvents which have been used with a higher boiling point can remain in the dispersion.

The polyurethane content of the dispersions can be in particular within the range from 5 to 70 percent by weight, preferably within the range from 20 to 50% by weight, based on the dispersions.

The dispersions may comprise customary assistants, for example thickeners, thixotropicizers, oxidation and UV stabilizers or release agents.

Hydrophobic assistants which may be difficult to disperse homogeneously in the finished dispersion can also be added according to the method described in U.S. Pat. No. 4,306,998 to the polyurethane or the prepolymer before the dispersing.

Suitable isocyanates, the second component of mixtures (D), are in principle all compounds having at least one free isocyanate group. Particular importance here is possessed by the customary diisocyanates, the customary higher functional polyisocyanates, as described in conjunction with the hydrophilic modified polyisocyanates (C), and also the hydrophilic modified polyisocyanates themselves described under (C). However, monoisocyanates such as phenyl isocyanate or tolyl isocyanates are also suitable.

The polyurethanes mentioned and the isocyanates mentioned are generally present in the form of mixtures in a weight ratio of from 10:90 to 90:10, in particular from 25:75 to 75:25, especially from 40:60 to 60:40.

In a preferred embodiment, compounds (D) comprise mixtures of polyesterurethanes and aliphatic diisocyanates, aliphatic higher functional polyisocyanates or hydrophilic modified polyisocyanates in a weight ratio of from 10:90 to 90:10.

Compounds (A) to (D) can generally be employed in aqueous system, preferably in aqueous solution or emulsion, in the novel process for preparing cellulose fibers, in which case the aqueous system generally comprises, based on the weight of the aqueous system, from 0.1 to 20% by weight, preferably from 0.5 to 10% by weight, of compounds (A) to (D).

Processes for producing solvent-spun cellulose fibers generally comprise 4 steps.

Step 1: Dissolving the cellulose in a water-miscible solvent

Step 2: Extruding the solution through a die to form a fiber precursor

Step 3: Treating the fiber precursor with water to remove solvent and form the cellulose fibre Step 4: Drying the fiber The preferred solvent for step 1 is N-methylmorpholine N-oxide.

The wet fiber obtained in step 3 is never-dried fiber and generally has a water content of from 120 to 150% by weight, based on the weight of the bone-dry fiber.

The water content of the dried fiber is generally from 60 to 80% by weight, based on the weight of the bone-dry fiber.

The novel treatment with compounds (A) to (D) can be effected either on the wet fiber (during or after step 3) or on the dried fiber (after step 4). However, a treatment at the fiber-forming stage (step 2), for example in a coagulation bath, is also possible.

When the treatment is carried out on the wet fiber, this can be effected for example by adding the aqueous system of compounds (A) to (D) to a circulating bath comprising the fiber precursor. The fiber precursor can be present in the form of a staple fiber, for example.

When the treatment is carried out on the dried fiber, this dried fiber can be present for example as staple fiber, web, yarn, knit or woven. In this case the fibers can be treated in an aqueous liquor, for example.

In contradistinction to the method described in EP-A-538 977, the presence of alkali can be dispensed with in the process of this invention.

The treatment is generally effected at from 20° C. to 200° C., preferably at from 40° C. to 180° C. In the course of the treatment, a chemical reaction takes place between compounds (A) to (D) and the hydroxyl groups of the cellulose, which may also involve a chemical link being formed between hydroxyl groups of different cellulose fibrils. This improves the stability of the fiber.

The treatment time is customarily within the range from 1 second to 20 minutes, preferably within the range from 5 to 60 seconds, in particular within the range from 5 to 30 seconds.

In the case of impregnation, the treatment can be carried out not only at room temperature (20° C.) with subsequent drying at up to 100° C. but also in the course of curing steps at up to 200° C., in particular within the range from 150° C. to 180° C.

The treatment of the wet or dried fiber can be effected with from 0.1 to 10% by weight, preferably from 0.2 to 5% by weight, in particular from 0.2 to 2% by weight, based on the weight of the bone-dry fiber, of compounds (A) to (D). However, in some cases it can also be advantageous to exceed the stated amounts, and use up to 20% by weight, for example.

The treatment may be carried out using further customary assistants in customary amounts- A particular reference should be made here to antimigration agents, for example antimigration agents based on ethoxylation products.

If compounds (A) and/or (B) are used for the purposes of this invention, the reactivity of these agents can be adapted to the process requirements, i.e. generally raised, by addition of catalytic amounts of Lewis acids such as $MgCl_2$, $ZnCl_2$, $AlCl_3$, $BF_3$ or systems such as $MgCl_2/NaBF_4$ or $MgSO_4/NaBF_4/LiCl$ or of inorganic or organic acids or corresponding acid salts, for example HCl, $H_2SO_4$, $H_3PO_4$, p-toluenesulfonic acid, methanesulfonic acid, $NaHSO_4$, $NaH_2PO_4$, $(NH)_4HSO_4$ or trialkylamine hydrochloride, or of other crosslinking inorganic salts, for example nitrates or tetraalkylammonium salts.

As mentioned, compounds (A) to (D), unlike the compounds described in EP-A-538 977, can be fixed purely thermally (without alkali), making them convenient to integrate in the fiber

We claim:

1. A process for producing solvent-spun cellulosic fibers having a reduced tendency to fibrillate, which comprises treating the fibers with one or more compounds selected from the group consisting of 1) hydrophilic modified polyisocyanates; and 2) mixtures of polyurethanes with isocyanates.

2. The process of claim 1, wherein compounds (1) are nonionically hydrophilic modified polyisocyanates containing hydroxyl-terminated polyethers of the formula (VII):

$$R^8—E—(DO)_n—H \quad (VII)$$

wherein $R^8$ is $C_1$–$C_{20}$-alkyl, $C_2$–$C_{20}$-alkenyl, cyclopentyl, cyclohexyl, glycidyl, hydroxyethyl, phenyl, tolyl, benzyl, furfuryl or tetrahydrofurfuryl;

E is sulfur or oxygen;

D is propylene or ethylene; and n is from 5 to 120.

3. The process of claim 1, wherein compounds (2) are mixtures of polyesterurethanes and aliphatic diisocyanates, aliphatic higher functional polyisocyantes or hydrophilic modified polyisocyantes in a weight ratio of from about 10:90 to 90:10.

4. The process of claim 1, wherein the fibers are treated with from 0.1 to 10% by weight of compounds (1) to (2) based on the dry weight of the fibers.

5. The process of claim 1, wherein the treatment is carried out at from about 20° to 200° C.

6. The process of claim 1, wherein said hydrophilic modified polyisocyanates are based upon aliphatic diisocyanates, cycloaliphatic diisocyanates, aromatic diisocyanates or polyisocyanates having a functionality of greater than two.

7. The process of claim 6, wherein said aliphatic diisocyanates are selected from the group consisting of tetramethylene diisocyanate, hexamethylene diisocyanate, octamethylene diisocyanate, decamethylene diisocyanate, dodecamethylene diisocyanate, tetradecamethylene diisocyanate, trimethylhexane diisocyanate and tetramethylhexane diisocyanate.

8. The process of claim 6, wherein said cycloaliphatic diisocyanates are selected from the group consisting of 1, 4-, 1, 3-, 1, 2-diisocyanatocyclehexane, 4, 4'-di (isocyanatocyclohexyl) methane, 1-isocyanato-3, 3, 5-trimethyl-5-(isocyanatomethyl cyclohexane, 2, 4- and 2, 6- diisocyanato-1-methylcyclohexane.

9. The process of claim 6, wherein said aromatic diisocyanates are selected from the group consisting of 2, 4-, 2, 6- tolyene diisocyanate, p-xylylene diisocyanate, 2, 4'-, 4, 4'-phenylene diisocyanate, 1, 5-naphthylene diisocyanate, diphenylene 4, 4'-diisocyanate, 4, 4'-diisocyanato-3, 3'-dimethyldiphenyl, 3-methyldiphenylmethane 4, 4'-diisocyanate and diphenyl ether 4, 4'-diisocyanate.

10. The process of claim 6, wherein said polyisocyanates having a higher functionality than two are selected from the groups consisting of 2, 4, 6-triisocyanatotoluene, 2, 4, 4'-triisocyanatodiphenyl ether and mixtures of tri- and hipher polyisocyanates which are obtained by phosgenation of aniline/formaldehyde condensates and are methylene-bridged polyphenyl polyisocyanates.

* * * * *